US006460497B1

(12) United States Patent
Hodgson

(10) Patent No.: US 6,460,497 B1
(45) Date of Patent: Oct. 8, 2002

(54) HODGSON PISTON TYPE ENGINE

(76) Inventor: Donald Eugene Hodgson, 400 Young Ct., #4, Erie, CO (US) 80516

( * ) Notice: Subject to any disclaimer, the term of this patent is extended or adjusted under 35 U.S.C. 154(b) by 0 days.

(21) Appl. No.: 09/687,168

(22) Filed: Oct. 16, 2000

(51) Int. Cl.[7] ..... F01L 1/02
(52) U.S. Cl. ..... 123/90.31; 123/197.1
(58) Field of Search ..... 123/90.1, 90.22, 123/90.23, 90.31, 197.1, 90.6

(56) References Cited

U.S. PATENT DOCUMENTS 4,736,717 A * 4/1988 Fujikawa ..... 123/90.6
5,243,938 A * 9/1993 Yan ..... 123/197.1

* cited by examiner

*Primary Examiner*—Noah P. Kamen

(57) ABSTRACT

An internal combustion engine having a cam for the rockerarm machined vertical on the crankshaft. The rockerarm extends from the crankshaft cam to either an intake valve or an exhaust valve the rockerarm pivots arount the pivot pin. One end of the rockerarm rides against the cam on the crankshaft creating a back and forth movement which in turn creates movement to open or close valves.

8 Claims, 4 Drawing Sheets

HODGSON PISTON TYPE ENGINE

FIELD OF THE INVENTION

This invention is directed to engines for the use in automobiles, motorcycles, lawnmowers, and similar types of machines that use gasoline, diesel, propane or other types fuel, for two or four stroke piston, rotary and diesel engines.

BACK GROUND OF THE INVENTION

There have been no suggestions in prior art to Internal Combustion Engines as this.

BRIEF SUMMARY OF THE INVENTION

This invention relates to internal combustion engines, air or water cooled. Where some type of fuel is mixed with air in a carburator or fuel injection system, this mixture is passed thru an intake port or ports into the cylinder and sealed by an intake valve or valves. This fuel is compressed in the cylinder and ingited by an electric spark or glow plug in the cylinder. The gases expand and thrust the piston to and fro. Acting through an interface the piston inparts a rotary motion by means of a cam located on the drive shaft. The burned gases must be removed from the cylinger, the exhaust valve or valves are opened allowing the burned gases to escape. The intake and exhaust valves opened and closed by means of a rocker arm that pivots to and fro by means of cam lobes, these lobes are positioned on the driveshaft and in co-operation with the pistons so that either valve is open or closed depending on the position of the piston. The interface that mates the piston with the driveshaft, can be any shape so long as it will allow the piston and driveshaft to cooperate with each other. Each cylinder and cylinder head are separated from the engine block and bolted on, making it easy to change the engine configuration depending on the application of the engine. By bolting on the cylinders this way it is easy to make engines with one or more cylingers in different shapes, such as a V block, Inline, Flat or Radial. These and other objects of the invention will be apparent from the following more particular description of the preferred embodiment as illustrated in the accompaning drawings in which reference characters refer to the same parts throughout the various views. The drawings are not necessarily to scale, emphasis instead being placed upon illustrating the principles of the invention.

DETAILED DESCRIPTION OF THE INVENTION

Figure 1:
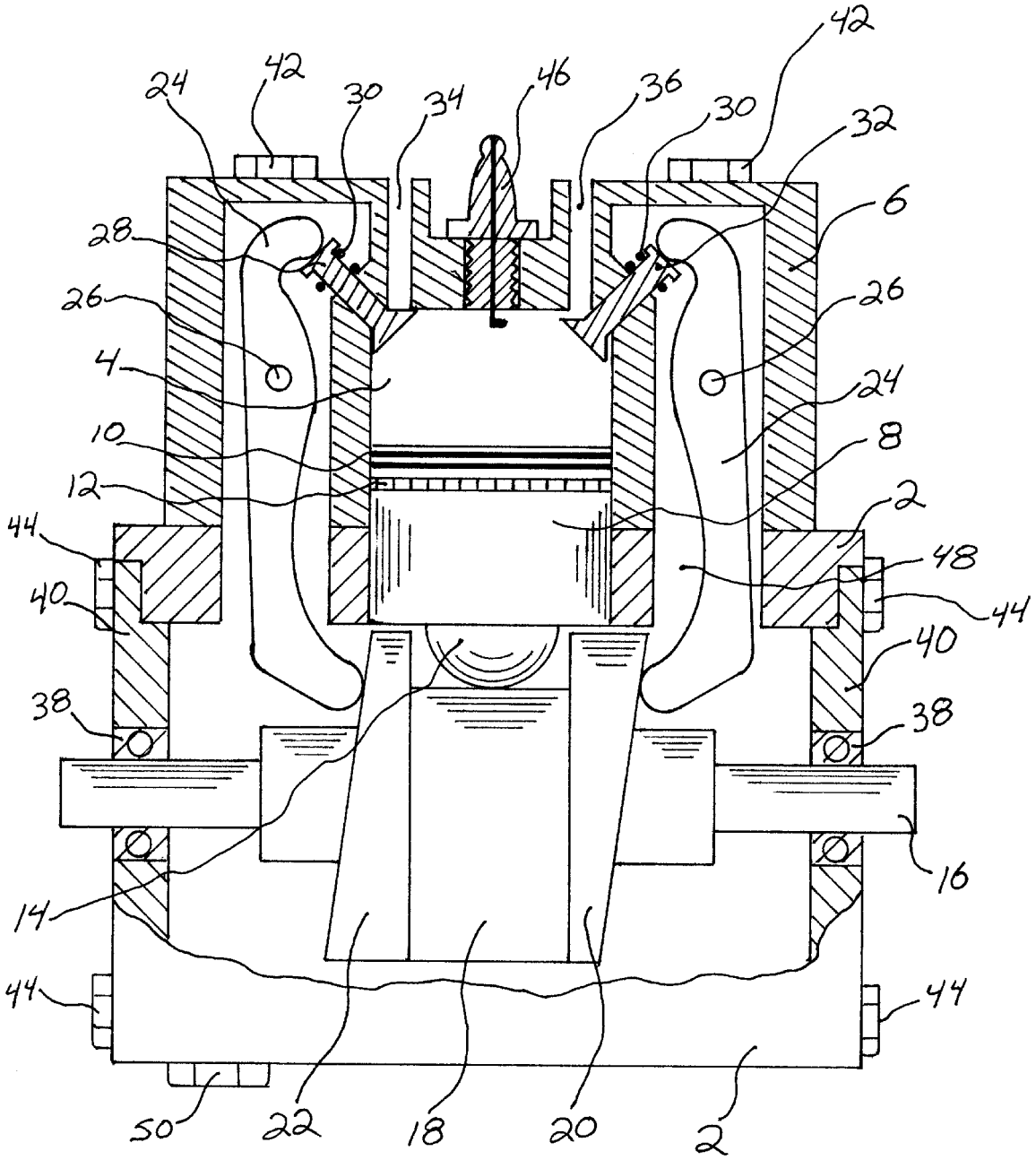
FIG. 1 is an enlarged fragmentary sectional view, detailing one cylinder of the invention.
Figure 2:
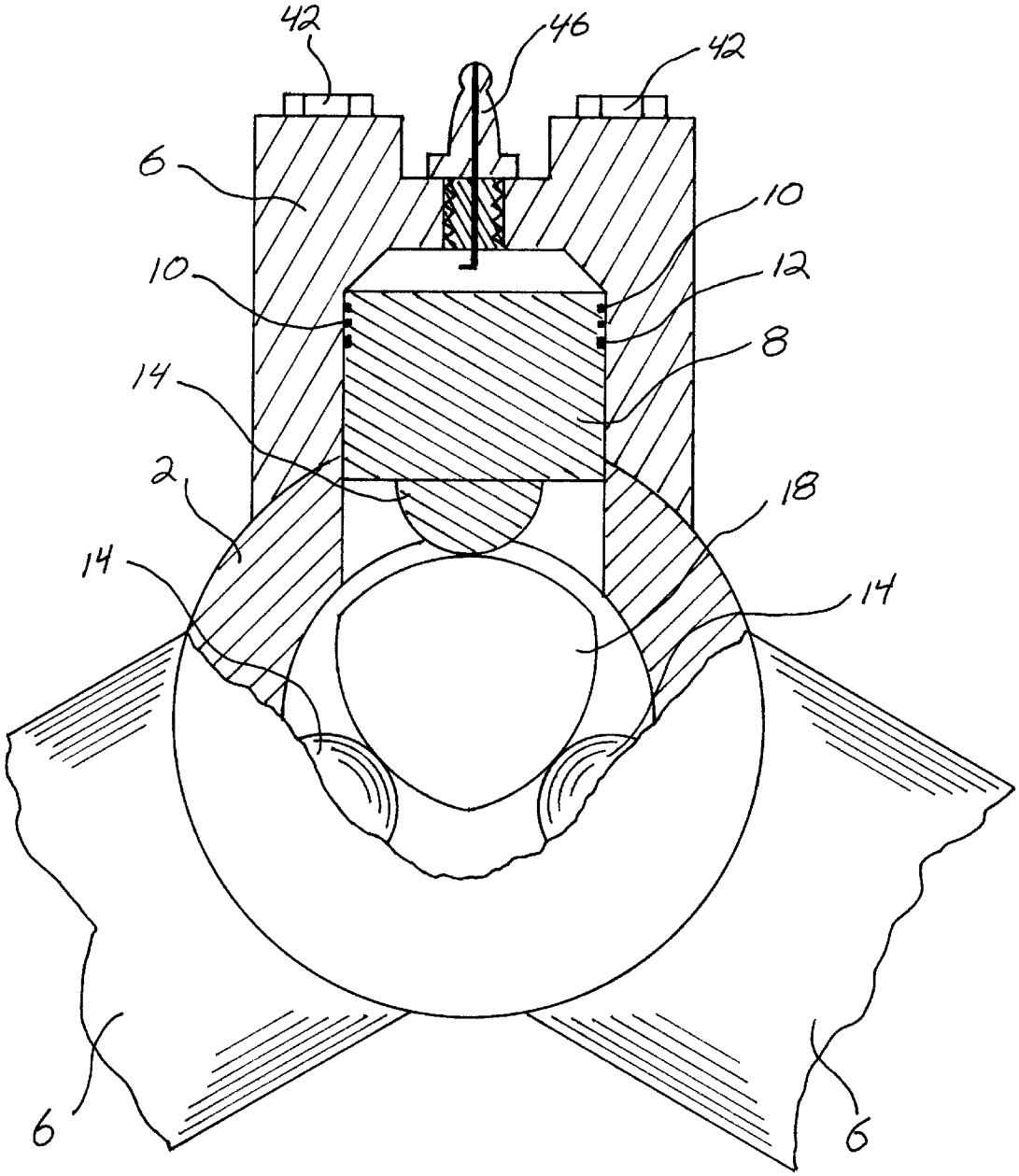
FIG. 2 is a fragmentary transverse cross sectional view of the engine configured in the three cylinder radal shape.
Figure 3:
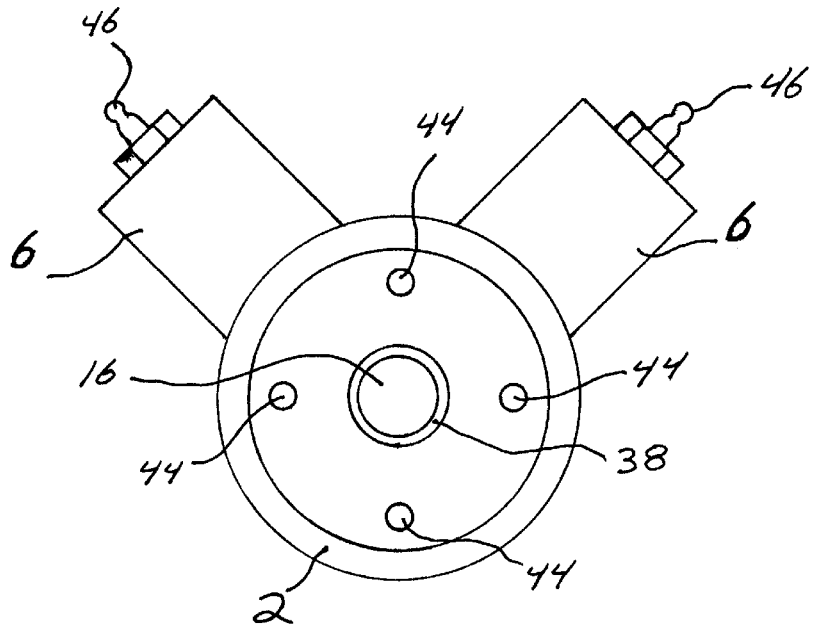
FIG. 3 is an end elevational view of the invention in the V block configuration.
Figure 4:
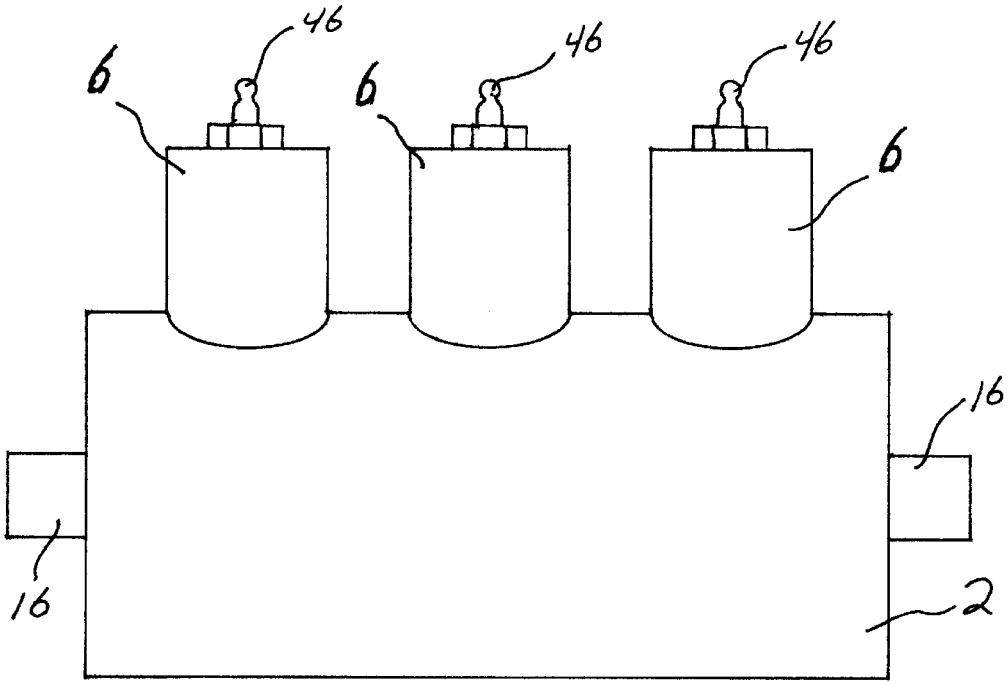
FIG. 4 is a side elevation view of the invention in the inline configuration.
Figure 5:
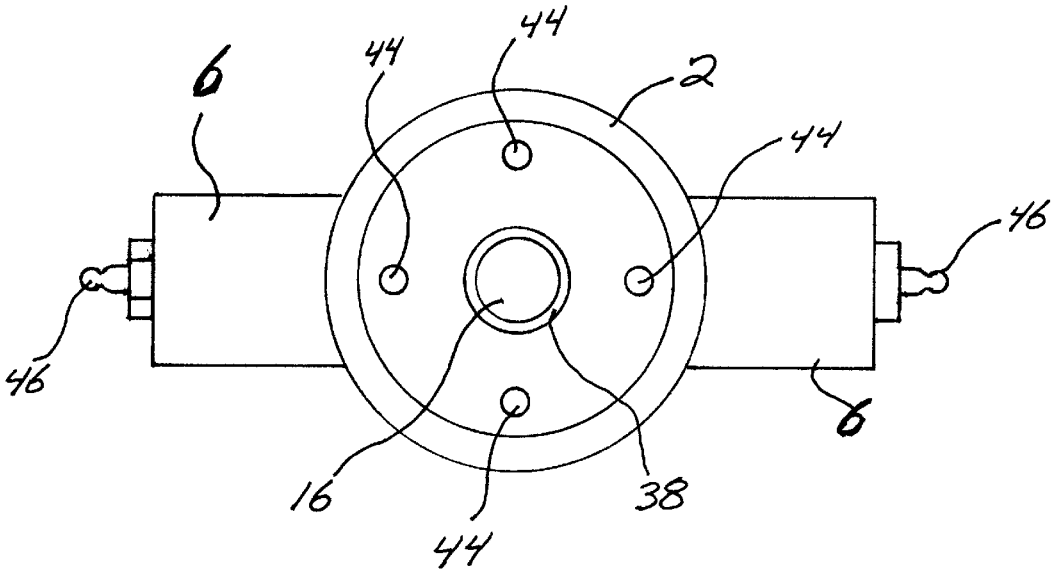
FIG. 5 is an end elevation view of the invention in flat configuration.

In FIGS. 1 and 2 there is illustrated a engine having an engine block, 2 on top of the block 2 a cylinder 4 with cylinder head 6 is secured there to by head bolts 42, located inside the cylinder, piston 8 having compression rings 10 and oiling ring 12. At one end of the piston, a piston interface 14 extending through cylinder 4. A driveshaft 16 provides the driveshaft interface 18, exhaust cam 20 and intake cam 22, means for spark lug 46 is located in cylinder head 6. The cylinder 4 and cylinder head 6 are provided with cavaties 48 mounted in cavities are rocker arms 24 and pivit pins 26. At one end of the rocker arms 24 a valve is located either an intake valve 28 or exhaust valve 32, a valve spring 30 is located on each valve. The valves are used to allow gases into and out of cylinder thru intake port 34 or exhaust port 36. At each end of the engine block 2 an end cap 40 is secured thereto by bolts 44 a drain plug 50 is located in the block to drain fluids if necessary. In FIG. 3, 4 and 5 is illustrated the invention in three different configurations V Block, Inline and Flat.

What is claimed is;

1. An engine comprising:

a piston defining a combustion chamber with a cylinder and cylinder head, a drive shaft driven by said piston, an engine block containing said combustion chamber and said drive shaft; said drive shaft further comprising intake and exhaust cams for driving intake and exhaust rocker arms which operate intake and exhaust valves in said cylinder head; wherein said rocker arms extend a long the length of the cylinder.

2. The engine of claim 1, further comprising ignition means in said cylinder head.

3. The engine of claim 1, wherein the cylinder and cylinder head define cavities in which the rockers arms are located.

4. The engine of claim 1, wherein the drive shaft has a cam driven by said piston.

5. The engine of claim 1, wherein the engine is constructed as a V-type engine.

6. The engine of claim 1, wherein the engine is constructed as an inline engine.

7. The engine of claim 1, wherein the engine is constructed flat type engine.

8. The engine of claim 1, wherein the engine is constructed as a radial type engine.

* * * * *